US009038234B2

(12) United States Patent
Monson

(10) Patent No.: US 9,038,234 B2
(45) Date of Patent: May 26, 2015

(54) ROTARY CLEANING HEAD

(76) Inventor: Charles B. Monson, Bellevue, WA (US)

( * ) Notice: Subject to any disclaimer, the term of this patent is extended or adjusted under 35 U.S.C. 154(b) by 2132 days.

(21) Appl. No.: 11/731,996

(22) Filed: Apr. 2, 2007

(65) Prior Publication Data

US 2007/0251047 A1 Nov. 1, 2007

Related U.S. Application Data

(60) Provisional application No. 60/795,544, filed on Apr. 27, 2006.

(51) Int. Cl.

| | |
|---|---|
| ***A47L 7/00*** | (2006.01) |
| ***A47L 11/30*** | (2006.01) |
| ***A47L 11/03*** | (2006.01) |
| ***A47L 11/40*** | (2006.01) |

(52) U.S. Cl.

CPC ..... *A47L 11/302* (2013.01); *A47L 11/03* (2013.01); *A47L 11/4036* (2013.01); *A47L 11/4044* (2013.01); *A47L 11/4075* (2013.01); *A47L 11/4077* (2013.01); *A47L 11/4088* (2013.01)

(58) Field of Classification Search

CPC ..... A47L 11/302; A47L 11/305; A47L 11/30; A47L 11/4044; A47L 11/4038

USPC ..... 15/320, 322

See application file for complete search history.

(56) References Cited

U.S. PATENT DOCUMENTS

| | | | | |
|---|---|---|---|---|
| 2,168,692 | A * | 8/1939 | Vidal | 15/320 |
| 3,619,848 | A * | 11/1971 | Salzman | 15/170 |
| 3,644,960 | A * | 2/1972 | Danzig | 15/322 |
| 3,908,220 | A | 9/1975 | Adamson et al. | |
| 4,127,913 | A | 12/1978 | Monson | |
| 4,182,001 | A * | 1/1980 | Krause | 15/320 |
| 4,264,999 | A | 5/1981 | Monson | |
| 4,333,204 | A * | 6/1982 | Monson | 15/321 |
| 4,339,840 | A | 7/1982 | Monson | |
| 4,441,229 | A | 4/1984 | Monson | |
| 4,692,959 | A | 9/1987 | Monson | |
| 4,731,956 | A | 3/1988 | Wood | |

(Continued)

FOREIGN PATENT DOCUMENTS

| | | |
|---|---|---|
| GB | 2098466 | 11/1982 |
| GB | 2437484 | 10/2007 |

OTHER PUBLICATIONS

Hydramaster Corporation, Mukilteo, WA, USA, RX-20HE, Web Site Advertising Materials, 2 pages, downloaded Sep. 28, 2010.

(Continued)

*Primary Examiner* — Bryan R Muller

(74) *Attorney, Agent, or Firm* — Gregory W. Moravan

(57) ABSTRACT

A rotary cleaning head that may have a main disc, a cover, and vacuum heads. The cover may define an axially aligned central vacuum opening; and the main disc and cover may define therebetween a vacuum distribution hub and vacuum channels for distributing vacuum from the cover's central vacuum opening to the vacuum slots in the vacuum heads. A dual purpose seal may provide a seal between the cover and the main disc, and may also define at least part of the vacuum hub and vacuum channels. The vacuum heads may have vacuum notches or ridges that may help to collect and direct the cleaning fluid on at least part of the vacuum heads' outer surfaces into vacuum heads' vacuum slots. The rotary cleaning head may be modified to clean either hard surfaces or soft surfaces.

14 Claims, 12 Drawing Sheets

(56) References Cited

U.S. PATENT DOCUMENTS

| | | | | |
|---|---|---|---|---|
| 4,788,738 | A | 12/1988 | Monson et al. | |
| 4,930,178 | A | 6/1990 | Monson et al. | |
| 5,289,610 | A | 3/1994 | Monson | |
| 5,392,490 | A | 2/1995 | Monson | |
| 5,517,715 | A | 5/1996 | Monson | |
| 5,706,549 | A * | 1/1998 | Legatt et al. | 15/385 |
| 6,032,326 | A | 3/2000 | Roden et al. | |
| 6,643,894 | B1 * | 11/2003 | Dell | 15/385 |

OTHER PUBLICATIONS

Australian Examiner's first Report, Oct. 1, 2010, 2 pages, Regarding Australian Patent application No. 2007201721, corresponding to reference AR.

Australian Examiner's second Report, Feb. 22, 2011, 2 pages, Regarding Australian Patent application No. 2007201721, corresponding to reference AR.

UK Intellectual Property Office, 1 page, Jun. 22, 2007, Search Report regarding UK Patent Application No. GB0707660.7, corresponding to reference AR.

UK Intellectual Property Office, 2 pages, Dec. 6, 2010, First Examination Report regarding UK Patent Application No. GB0707660.7, corresponding to reference AR.

Co-pending U.S. Appl. No. 13/065,570, filed Mar. 4, 2011 for a Vacuum Head, having 30 pages of specification and claims, and 16 sheets of drawings.

Co-pending U.S. Appl. No. 13/136,708, filed Aug. 8, 2011 for a Cleaning Tool, having 19 pages of specification and claims, and 5 sheets of drawings.

* cited by examiner

ROTARY CLEANING HEAD

CROSS REFERENCE TO RELATED APPLICATION

This application claims the benefit under 35 U.S.C. 119(e) of U.S. Provisional Application No. 60/795,544 filed on Apr. 27, 2006.

BACKGROUND OF THE INVENTION

The present invention relates to floor cleaning machines for hard or soft surfaces; and more particularly, it relates to rotary cleaning heads for floor cleaning machines.

BRIEF SUMMARY OF THE INVENTION

There has been a long felt need for a simple, economical and effective rotary cleaning head for floor cleaning machines that may solve some of the problems associated with conventional rotary cleaning heads.

For example, one problem that may be solved by the present invention is how to provide a rotary cleaning head that distributes vacuum to the rotary cleaning head's vacuum heads in a simple, effective, and efficient way, despite the rotation of the rotary cleaning head during use. The present invention may solve this problem by providing a rotary cleaning head that may comprise a main disc and a cover, wherein the cover may define an axially aligned central vacuum opening that may be adapted to be connected to a source of vacuum; and wherein the main disc and cover may define therebetween a vacuum distribution hub and one or more vacuum channels for efficiently distributing vacuum from the cover's central vacuum opening to the vacuum slots in the vacuum heads, via vacuum slots located in the main disc. The vacuum channels may also serve the dual function of helping to guide the flow of air, used cleaning fluid, dirt and debris through the rotary cleaning head in a way that reduces, if not eliminates, any areas within the rotary cleaning head that might otherwise tend to trap some of the used cleaning fluid, dirt and debris.

Another problem that may be solved by the present invention is how to quickly, easily and efficiently provide a seal between the cover and the main disc, while simultaneously providing a means that may define at least part of the vacuum distribution hubs and vacuum channels within the rotary cleaning head. The present invention may solve this problem by providing a relatively thick seal that is located between the cover and the main disc. The seal's outer periphery may provide a seal between the outer portions of the cover and the main disc, while other portions of the seal may define at least part of the vacuum distribution hub and the vacuum channels within the rotary cleaning head.

Another problem that may be solved by the present invention is how to provide a rotary cleaning head that may be quickly, easily, and inexpensively modified so that it may be used to clean either hard surfaces or soft surfaces. A conventional rotary cleaning head for cleaning hard surfaces may include scrubbing bristles or scrubbing pads, squeegee equipped vacuum heads, and a sprayer for the cleaning fluid. Such a rotary cleaning head would not be useable for cleaning soft surfaces, such as carpeting, because the cleaning bristles or scrubbing pads would tend to snag or untwist the carpet fibers, and the squeegee equipped vacuum heads would not be very effective on a carpeted surface. On the other hand, a conventional rotary cleaning head for cleaning carpeted surfaces may include vacuum heads without squeegees, no cleaning bristles or cleaning pads, and a sprayer for cleaning fluid. Such a rotary cleaning head would not be very useable for cleaning hard surfaces, since it would lack squeegees and scrubbing bristles or scrubbing pads.

However, the rotary cleaning head of the present invention may be easily modified to clean either hard surfaces or soft surfaces because any type of vacuum head may be secured to the lower side of its main disc, which will then provide the vacuum heads with vacuum through the corresponding vacuum slots in the main disc. Similarly, the lower side of the main disc may, or may not, be provided with cleaning bristles or scrubbing pads, depending on whether it is a hard surface or a soft surface that is to cleaned.

Another problem that may be solved by the present invention is how to reduce, if not eliminate, the amount of cleaning fluid that may be slung out by the rotary cleaning head's vacuum heads during operation of the rotary cleaning head. The present invention may solve this problem by providing the vacuum heads with vacuum notches or ridges that may help to collect and direct the cleaning fluid on at least part of the vacuum heads' outer surfaces into vacuum heads' vacuum slots.

It should be understood that the foregoing summary of the present invention does not set forth all of its objects, features, advantages, characteristics, structures, materials, methods and processes; since these and further objects, features, advantages, characteristics, structures, materials, methods and processes of the present invention will be directly or inherently disclosed to those of ordinary skill in the art to which it pertains in view of all of the disclosures herein.

DETAILED DESCRIPTION OF THE INVENTION

Figure 1:
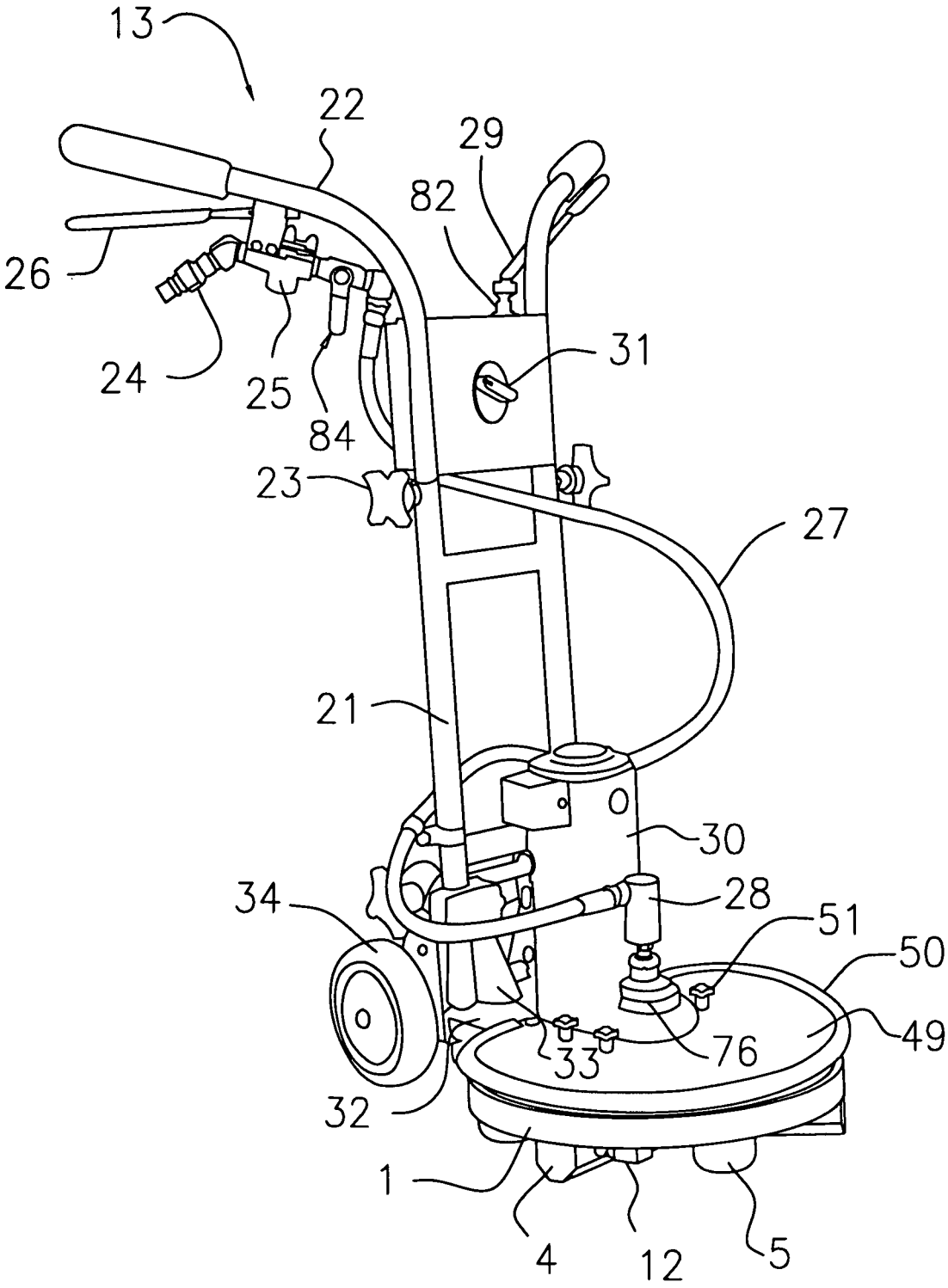
FIG. 1 is a perspective view showing the rotary cleaning head of the present invention installed in a floor cleaning machine.

Turning now to FIG. 1, the rotary cleaning head 1 of the present invention may be used with any suitable floor cleaning machine 13. A conventional floor cleaning machine 13 may typically comprise any suitable frame 21 and a pair of handles 22. The handles 22 may be made height adjustable in any suitable way, such as by telescoping them within frame 21 and selectively locking them in place with any suitable locking mechanism, such as a pair of locking knobs 23.

One of the handles 22 may carry a fluid coupling 24 to which a source of cleaning fluid may be attached. Any suitable cleaning fluid may be used, such as water for example, to which may be added any suitable cleaning agents such as detergents, anti-foam agents, or surfactants, for example.

Any suitable valve mechanism, such as a valve 25 actuated by a control lever 26, may be providing for controlling the flow of cleaning fluid to the rotary cleaning head 1 through a supply line 27 and a rotary fluid coupling 28. Any suitable flow control valve 84 may be provided, if desired, for further control of the flow of cleaning fluid to the rotary cleaning head 1. One of the handles 22 may carry any suitable control, such as a control lever 29 and a switch 82, for starting and stopping a drive motor 30 for the rotary cleaning head 1. The drive motor 30 may be attached to the lower part of the frame 21. The speed of the drive motor 30 may be set in any suitable way, in order to control the rotational speed of the rotary cleaning head 1, such as by use of a speed control knob 31 and any suitable associated electrical control circuitry.

Secured to the lower part of the frame 22 may be any suitable vacuum plenum 32, which may have any suitable vacuum coupling 33 (such as the pipe stub 33 illustrated in FIGS. 1 and 4), to which any suitable vacuum source may be attached. The vacuum plenum 32 may provide a source of vacuum for the rotary cleaning head 1, as will be described in more detail below. The vacuum plenum 32 may have any suitable size, shape and construction, as long as its inlet 81 is sized, shaped and located so as to provide an adequate source of vacuum for the vacuum opening 41 in the cover 7 of the rotary cleaning head 1.

As best seen in FIG. 1, an optional bump cover 49, with a resilient rim 50, may be secured to the top of the vacuum plenum 32 in any suitable way, such as with four screw knobs 51. The function of the bump cover 49 may be to help prevent the rotary cleaning head 1 from damaging walls and furnishings during operation, since the resilient rim 50 is slightly larger in diameter than the rotary cleaning head 1.

A pair of wheels 34 may be attached to the lower part of the frame 21 to enable the cleaning machine 13 to be moved more easily. Although not illustrated in FIG. 1 for clarity and simplicity, the cleaning machine 13 may include any suitable mechanism for permitting the handles 22 and at least part of the frame 21 to be tilted at any desired angle with respect to the vacuum plenum 32, for the comfort and convenience of the user.

Figure 14:
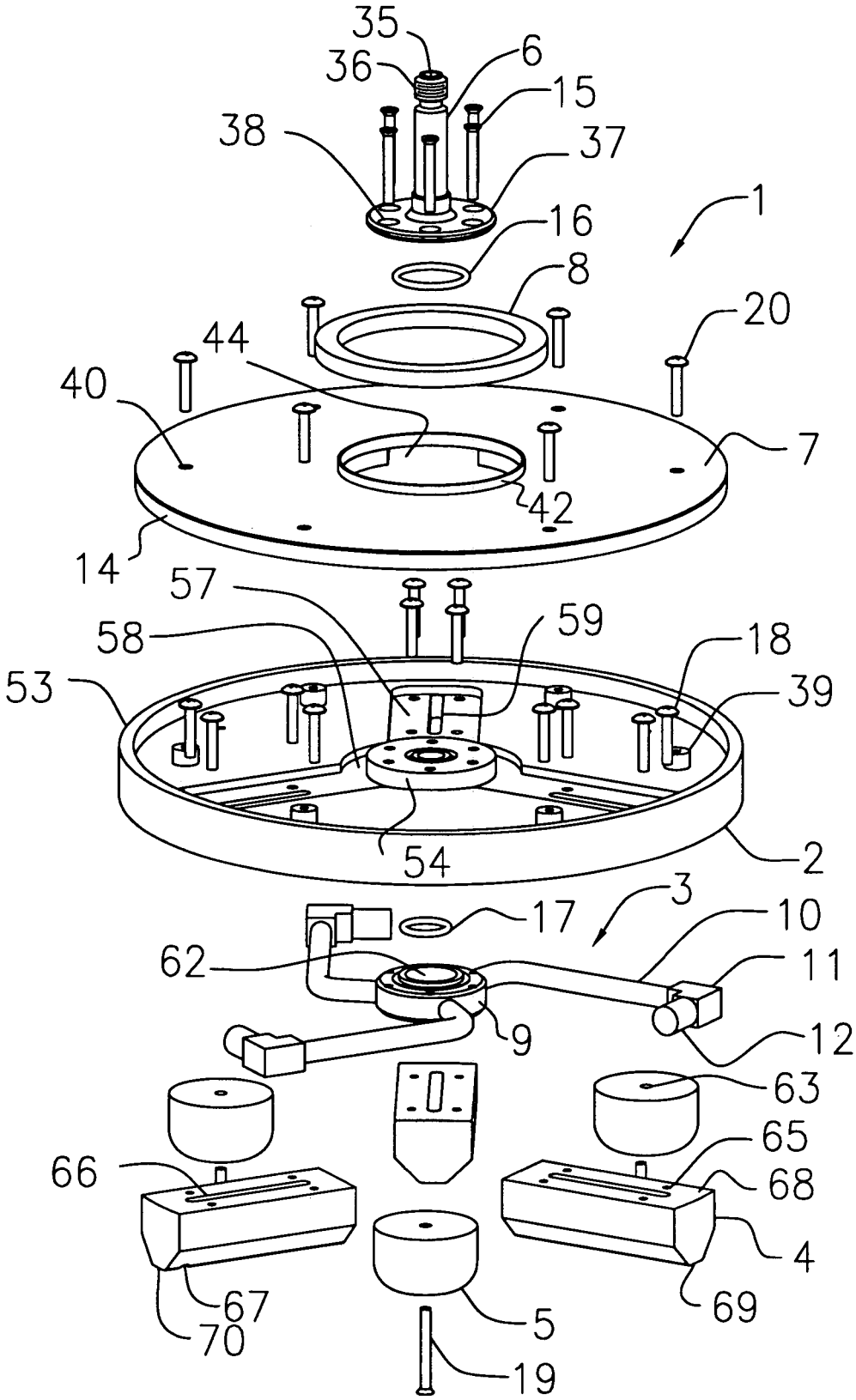
FIG. 14 is an exploded perspective view of the rotary cleaning head.

As best seen in FIG. 14, the rotary cleaning head 1 may comprise a spindle 6, a spindle O-ring 16, a seal 8, a cover 7, six hollow spacers 39, a seal 14, a main disc 2, a sprayer 3, a sprayer O-ring 17, three vacuum heads 4, three glide shoes 5, six each of assembly screws 15 and 20; four mounting screws 18 for each of the vacuum heads 4; and one mounting screw 19 for each of the glide shoes 5. The spacers 39 may be molded as an integral part of the main disc 2, rather than being separate elements.

The spindle 6 may have a cleaning fluid bore 35, drive threads 36, and a flange 37 having six mounting holes 38. The spindle 6 and cover 7 may be made of any suitable strong, durable material, such as metal, plastic, or composites.

The cover 7 may have six mounting holes 40 and a vacuum opening 41 surrounded by a flange 42 for positioning and holding the seal 8 in its proper location on the upper side of the cover 7. The vacuum opening 41 may be of any suitable size, shape, and location as long as it does not unduly restrict the flow of air, used cleaning fluid, dirt and debris into the inlet 81 of the vacuum plenum 32. Alternatively, the flange 42 may be eliminated, and the seal 8 may be positioned and held in its proper location on the cover 7 in any other suitable way, such as by gluing it in place with any suitable adhesive, for example. The adhesive may be selected such that the seal 8 may be easily removed, such as if it is worn out and a new seal 8 is needed. As further alternatives, the lower side of the vacuum plenum 32 may carry the seal 8; or the seal 8 may be held in place by simply being sandwiched between the upper side of the cover 7 and the lower side of the vacuum plenum 32.

The seal 8 may be used to prevent a vacuum leak between the upper side of the cover 7 and the lower side of the vacuum plenum 32. The seal 8 may have any suitable size, shape, construction and location, as long as it does not unduly restrict the flow of air, etc. through the vacuum opening 41 in the cover 7 and the inlet 81 of the vacuum plenum 32 during use of the rotary cleaning head 1. The seal 8 may be made from any suitable material, such as an elastomer or felt. Alternatively, a separate seal 8 may be eliminated, and the desired seal between the upper side of the cover 7 and the lower side of the vacuum plenum 32 may be provided in any other suitable way, such as by providing matching smooth sealing surfaces on the upper side of the cover 7 and the lower side of the vacuum plenum 32.

Figure 12:
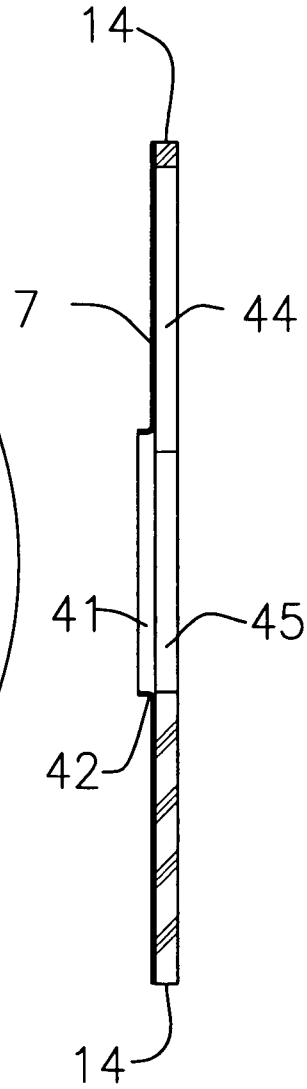
FIG. 12 is cross-sectional view of the cover and a seal, taken along line 12-12 of FIG. 11.
Figure 13:
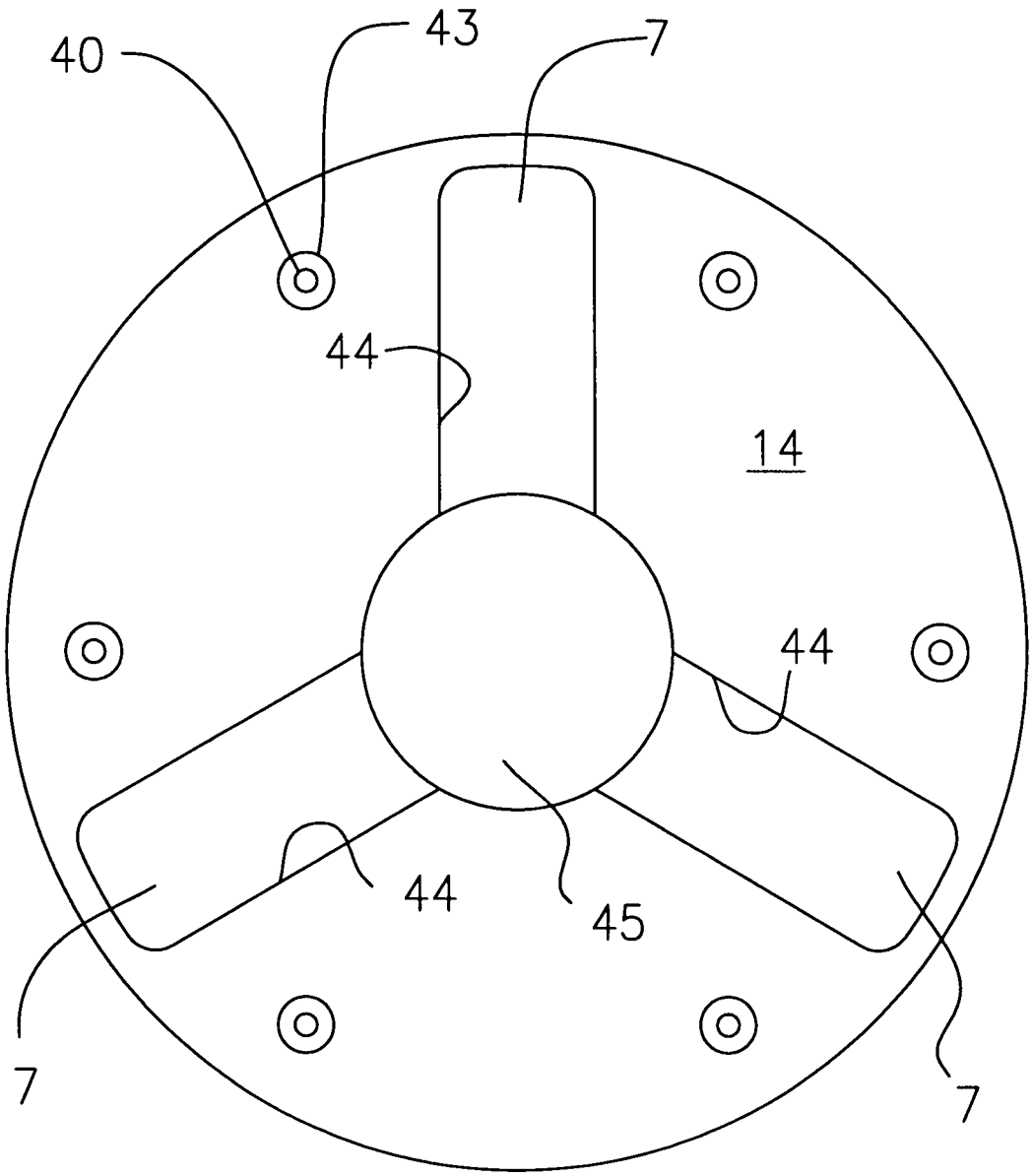
FIG. 13 is a bottom plan view of the cover and seal.

As best seen in FIGS. 12-13, the seal 14 may have six spacer holes 43 that are sized to receive the six spacers 39; and may also have three vacuum channels 44 in communication with its vacuum distribution hub 45. The seal 14 may be made from any suitable material, such as an elastomer or felt. The seal may be positioned and held in its proper location between the cover 7 and the main disc 2 in any suitable way, such as by being sandwiched therebetween, or by being secured in any suitable way to the lower side of the cover 7 or to the upper side of the main disc 2, such as by the use of any suitable adhesive. The seal 14 may have a thickness that is selected so that it may extend from the upper side of the main disc 2 to the lower side of the cover 7

One function of the seal 14 may be to prevent an undesired vacuum leak between the cover 7 and the main disc 2. As perhaps best seen in FIGS. 4, 12 and 13, the outer peripheral portion of the seal 14 may serve this function. Alternatively, the desired seal between the cover 7 and main disc 2 may be provided in any other suitable way, such as by providing a separate O-ring or other seal between the cover 7 and main disc 2; in which case the outer peripheral portion of the seal 14 may be eliminated. As a further alternative, the cover 7 may be enlarged so that it extends over the raised rim 53 of the main disc 2, and any suitable seal may then be provided between the cover 7 and the rim 53; in which case the outer peripheral portion of the seal 14 may again be eliminated.

Another function of the seal 14 may be to define its vacuum channels 44 and its vacuum distribution hub 45, which may have any suitable respective size and shape. The respective vacuum channels 44 in the seal 14 and the vacuum channels 57 in the main disc 2 may be aligned with each other, to form respective composite vacuum channels 44, 57. The vacuum channels 57 may be of any suitable size and shape, and the respective vacuum channels 44, 57 may not be of the same size and shape. Similarly, the vacuum distribution hub 45 in the seal 14 may be aligned with the vacuum distribution hub 58 in the main disc 2, to form a composite vacuum distribution hub 45, 58. The vacuum distribution hub 58 may be of any suitable size and shape, and the respective vacuum distribution hubs 45, 58 may not be of the same size and shape. As an alternative to one seal 14 defining the vacuum distribution hub 45 and all of the vacuum channels 44, a separate seal that extends between the upper surface of the main disc 2 and the lower surface of the cover 7 may define the vacuum distribution hub 45 or any particular vacuum channel 44.

One of the functions of the vacuum channels 44, 57 may be to help channel the flow of air, etc., from the vacuum slots 59 in the main disc 2 to the vacuum distribution hubs 45, 58. Another function of the vacuum channels 44, 57 may be to help guide the flow of air, used cleaning fluid, dirt and debris through the rotary cleaning head in a way the reduces, if not eliminates, any areas within the rotary cleaning head 1 that might otherwise tend to trap some of the used cleaning fluid, dirt and debris. One of the functions of the vacuum distribution hubs 45, 58 may be to help channel the flow of air, etc., from the vacuum channels 44, 57 to the vacuum opening 41 in the cover 7.

One vacuum channel 44, 57 may be provided for each vacuum slot 59 in the main disc 2. As an alternative, one or more of the vacuum channels 44 may be enlarged so that it merges together with an adjacent vacuum channel 44, in which case the corresponding portions of the seal 14 that would have been located between the merged vacuum channels 44 may be eliminated. As a further alternative, all portions of the seal 14 located between the vacuum channels 44 may be eliminated, resulting in one large vacuum channel 44 for all of the vacuum slots 59 in the main disc 2.

As a further alternative, one or more of the vacuum channels 44 in the seal 14 may be eliminated, in which case the seal 14 may extend into the areas that would have been occupied by the eliminated vacuum channels 44. This may be done, for example, if the corresponding vacuum channels 57 in the main disc 2 are enlarged in any suitable way so that they can perform the functions of the eliminated vacuum channels 44 in the seal 14.

If all of the vacuum channels 44 in the seal 14 are eliminated in the manner just described, then the entire seal 14 may be eliminated, and a seal between the cover 7 and the main disc 2 may be provided in any other suitable way, such as those that have been described above. There may, or may not, be a space provided between all or part of the cover 7 and the main disc 2 in this situation.

As a further alternative, the seal 14's vacuum distribution hub 45 may be eliminated, such as by eliminating the seal 14. This may be done if the corresponding vacuum distribution hub 58 in the main disc 2 is enlarged in any suitable way so that it can perform the functions of the eliminated vacuum distribution hub 45 in the seal 14. Here again, a seal between the cover 7 and the main disc 2 may be provided in any other suitable way, such as those that have been described above. There may, or may not, be a space provided between all or part of the cover 7 and the main disc 2 in this situation.

Figure 4:
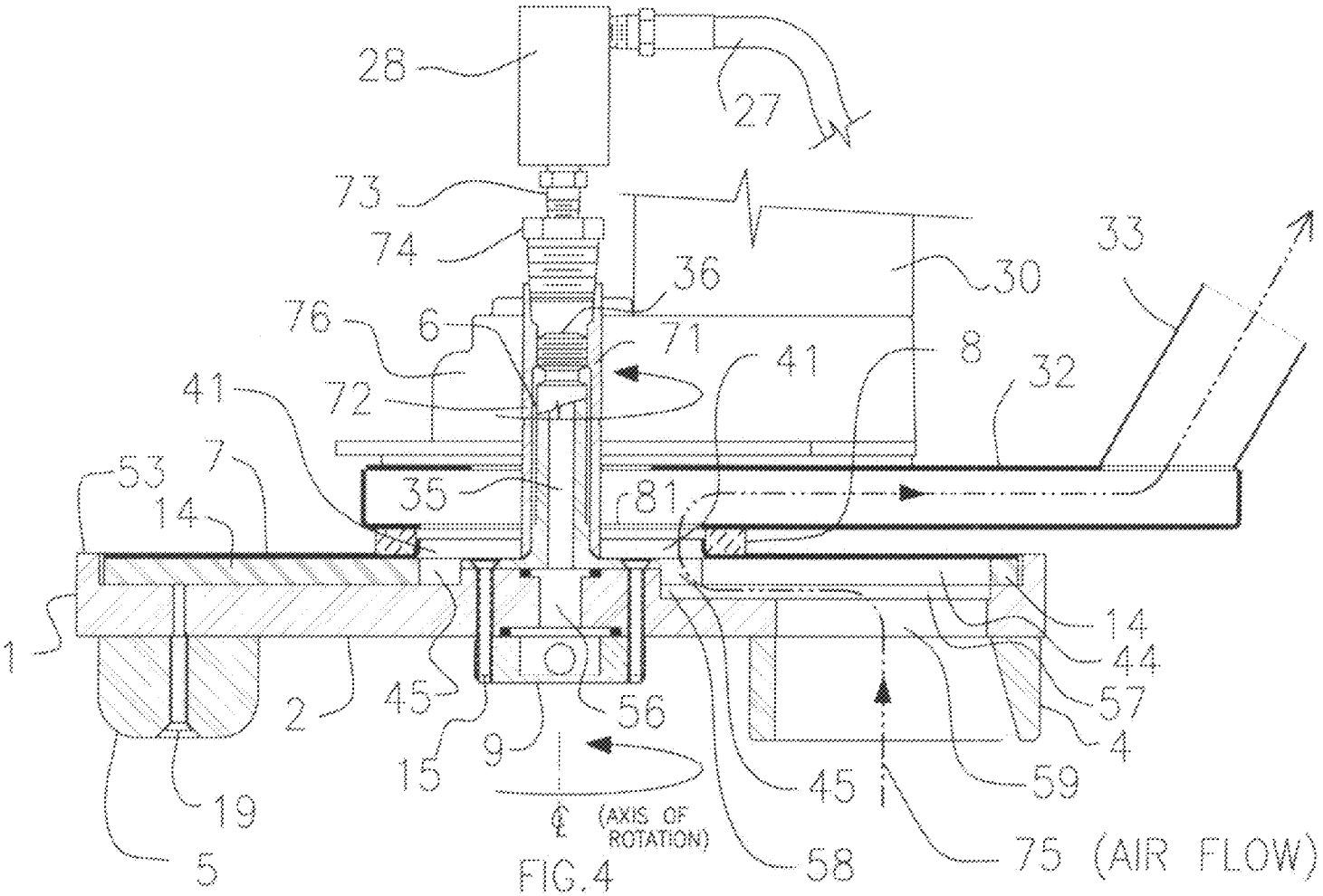
FIG. 4 is a cross-sectional view of the rotary cleaning head, taken along line 4-4 of FIG. 3, also showing the vacuum plenum in cross section, parts of the gear drive in elevation and cross-section, and the fluid coupling in elevation.
Figure 6:
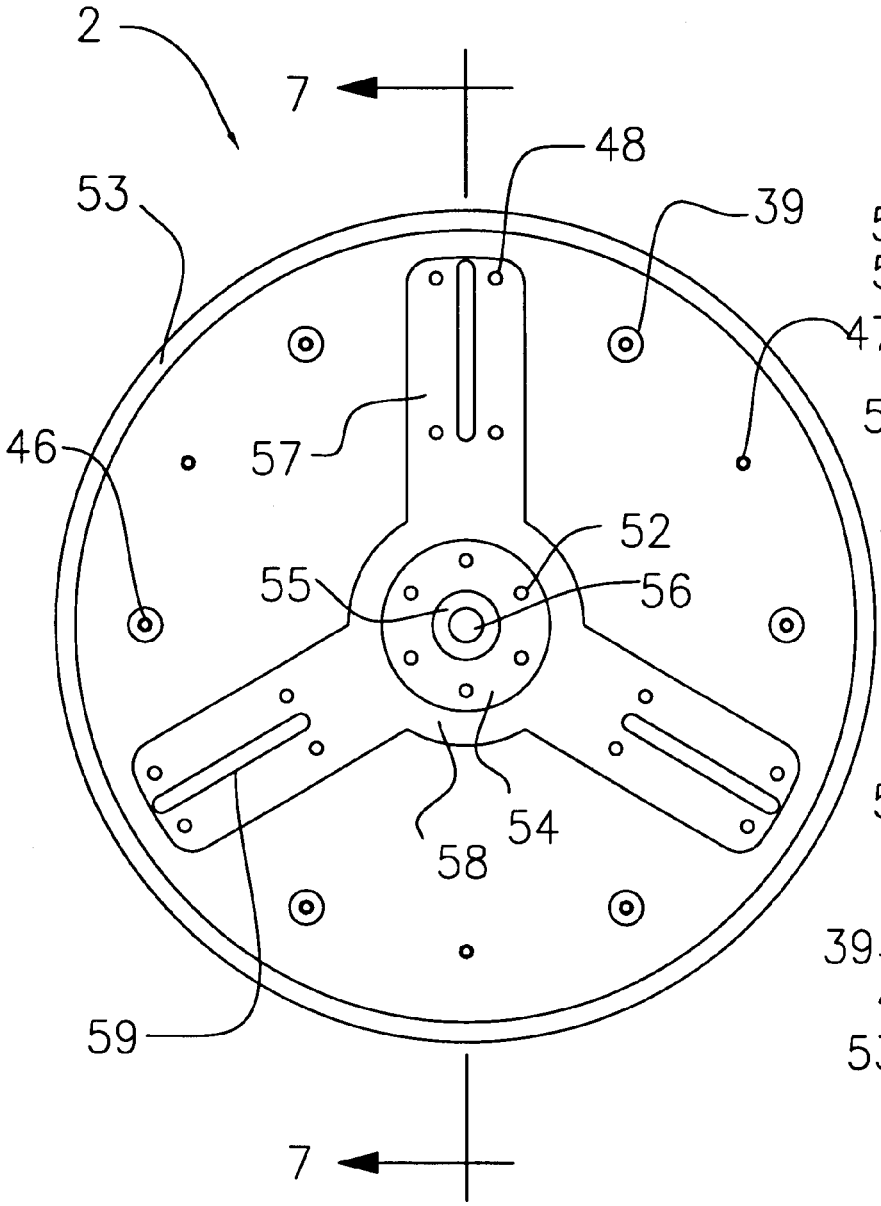
FIG. 6 is a top plan view of a main disc that may be used in the rotary cleaning head.
Figure 7:
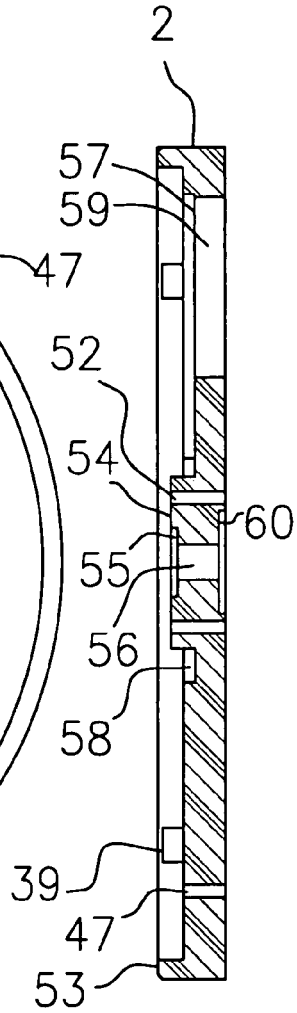
FIG. 7 is a cross-sectional view of the main disc, taken along line 7-7 of FIG. 6.
Figure 8:
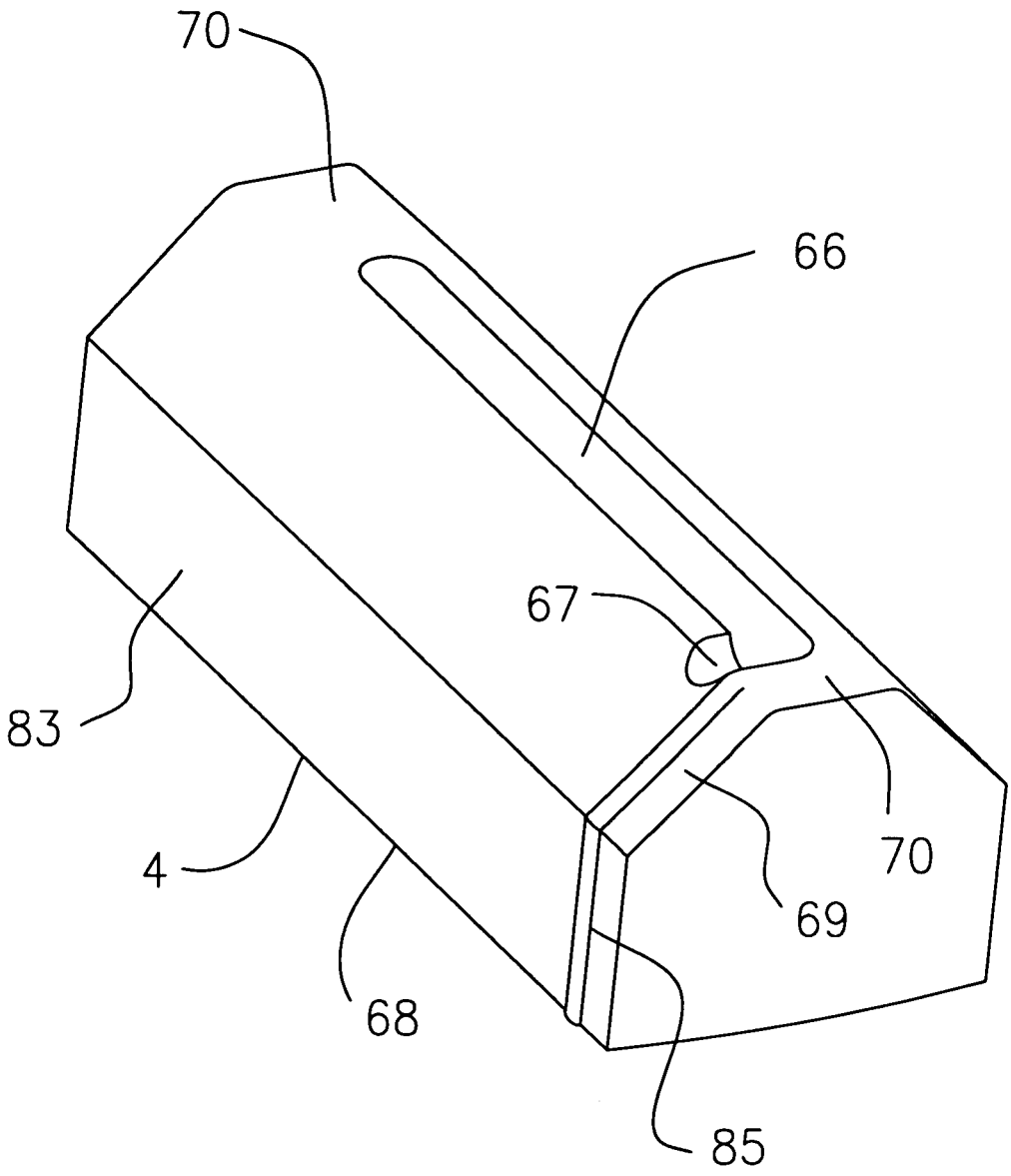
FIG. 8 is a perspective view showing the bottom of a vacuum head that may be used in the rotary cleaning head.

As best seen in FIGS. 4, 6, and 14, the main disc 2 may have six threaded mounting holes 46 for cover 7, each surrounded by a spacer 39; three threaded mounting holes 47, one for each of the glide shoes 5; twelve mounting holes 48 for vacuum heads 4, four for each of the vacuum heads 4; and six mounting holes 52 for the spindle 6 and sprayer 3. The main disc 2 may be made from any suitable strong, durable material, such as metal, plastic or composites; and may be made as one piece in any suitable way, such as by injection molding it from plastic.

The upper side of the main disc 2 may have a raised peripheral rim 53; a raised central boss 54 having a circular recess 55 for O-ring 16, and a fluid bore 56 for the cleaning fluid; three recessed vacuum channels 57 communicating with a recessed vacuum distribution hub 58; and three vacuum slots 59 in the vacuum channels 57 for the three vacuum heads 4. The lower side of the main disc 2 may have a circular recess 60 for O-ring 17.

The functions of the raised peripheral rim 53 may include helping to properly position and protect the cover 7 and seal 14. Alternatively, the rim 53 may be eliminated, such as if the seal 14 were eliminated, so that the cover 7 may rest close to, or on, the upper surface of the main disc 2.

As seen in FIGS. 6 and 14, one vacuum channel 57 may be provided for each of the vacuum slots 59. As an alternative, one or more of the vacuum channels 57 may be enlarged so that it merges together with an adjacent vacuum channel 57 to form an enlarged composite vacuum channel 57. As a further alternative, all of the vacuum channels 57 may be enlarged and merged, to form one large composite vacuum channel 57 for all of the vacuum slots 59.

As another alternative, one or more of the vacuum channels 57 in the main disc 2 may be eliminated. This may be done, for example, if the corresponding vacuum channels 44 in the seal 14 are enlarged in any suitable way so that they can perform the functions of the eliminated vacuum channels 57.

Figure 2:
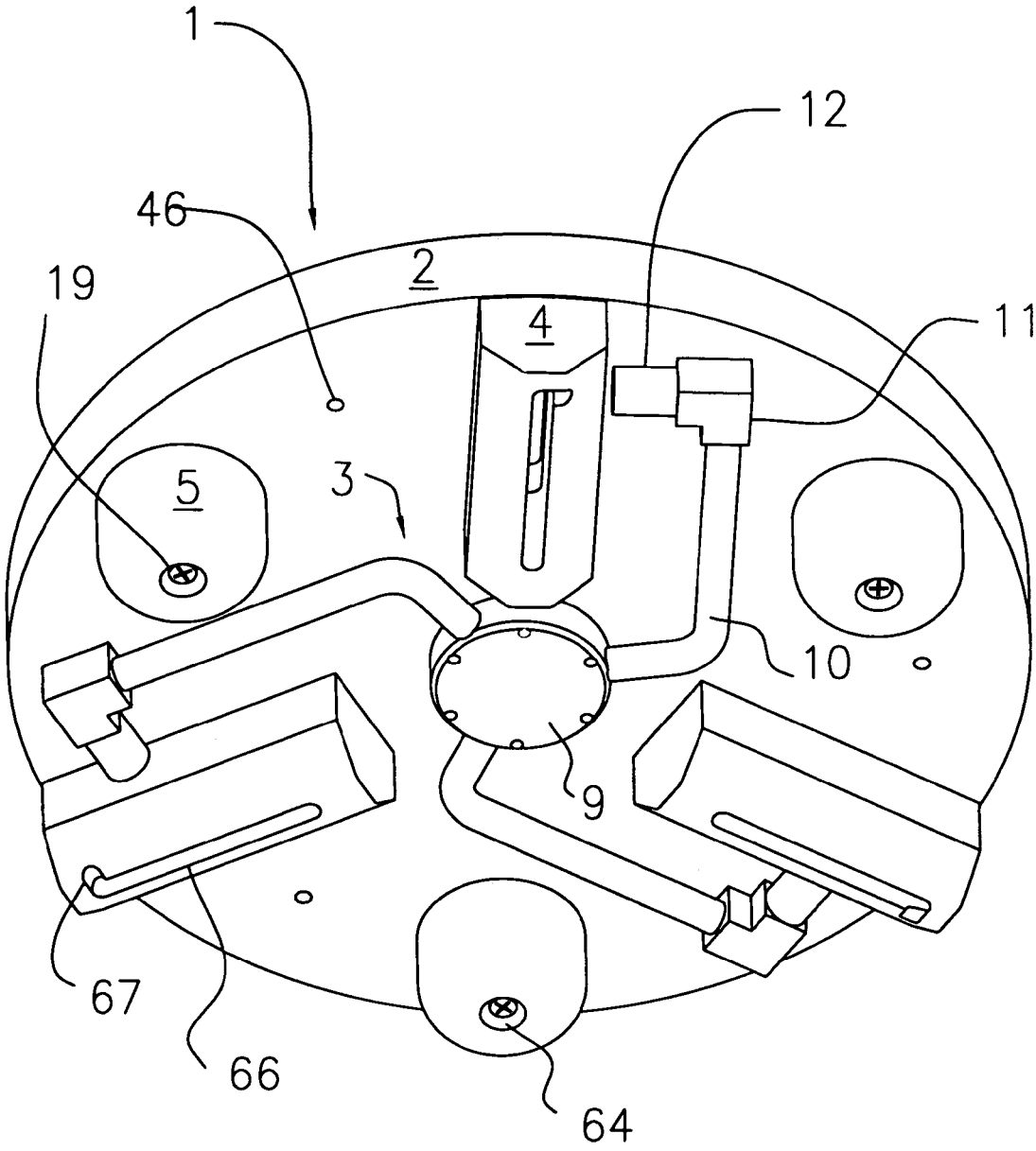
FIG. 2 is a perspective view showing the lower side of the rotary cleaning head.
Figure 3:
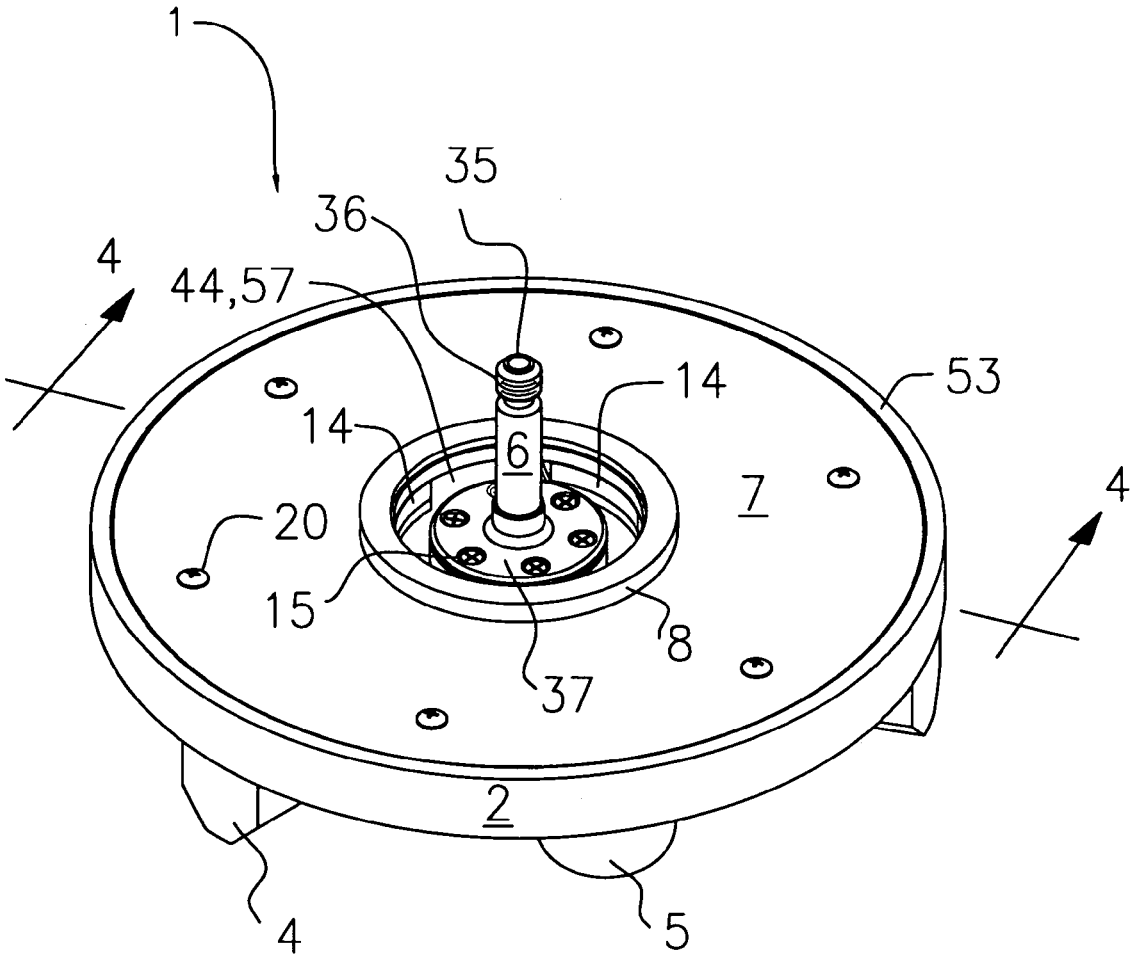
FIG. 3 is perspective view showing the upper side of the rotary cleaning head.
Figure 5:
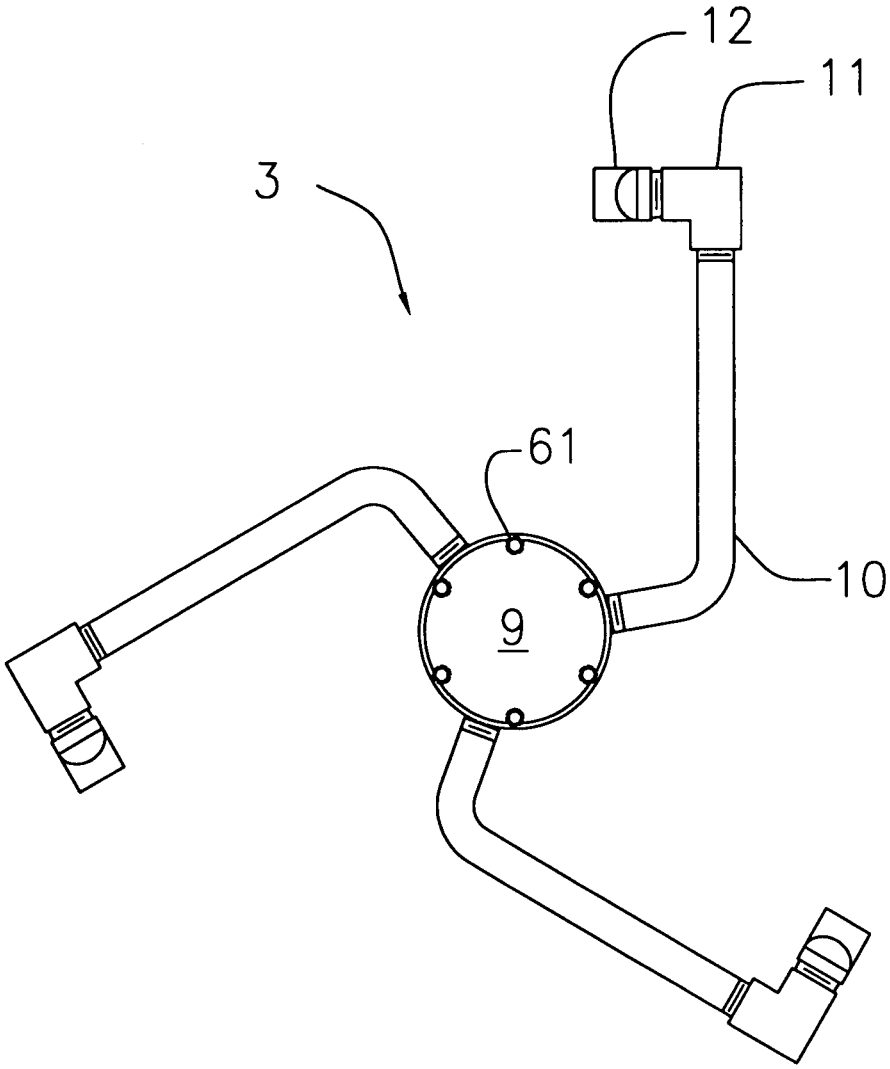
FIG. 5 is a bottom plan view of a sprayer that may be used in the rotary cleaning head.

As best seen in FIGS. 2, 5, and 14, the sprayer 3 may have a hollow hub 9 having six threaded mounting holes 61 and a central port 62 in its upper side; and three hollow spray arms 10, each terminating in a hollow elbow 11 and a spray nozzle 12. One of the functions of the sprayer 3 may be to deliver, in any suitable way, sprays of cleaning fluid to the surface being cleaned. The sprayer 3 may be of any suitable size, shape, construction and location; and may be made from any suitable strong, durable material such as metal, plastic or composites. The sprayer 3 may have any desired number of spray arms 10, with their associated elbows 11 and spray nozzles 12. As an alternative, the elbows 11 may be eliminated and replaced by a bent portion of the spray arms 10.

As best seen in FIGS. 2 and 14, each glide shoe 5 may have a mounting bore 63 for its mounting screw 19, and the lower end 64 of its mounting bore 63 may be enlarged, so that the head of its mounting screw 19 may be recessed below its lower surface. The glide shoes 5 may be of any suitable size, shape, construction and location; and may be made from any suitable strong, durable material such as metal, plastic or composites. The glide shoes 5 may have a vertical thickness that is selected to be about the same as that of the vacuum heads 4. One function of the glide shoes 5 may be to help support the main disc 2. There may be any desired number of the glide shoes 5. Alternatively, the glide shoes 5 may be eliminated.

As best seen in FIGS. 2, 8-10 and 14, each vacuum head 4 may have four threaded mounting bores 65 for its mounting screws 18, a vacuum slot 66, and a vacuum notch 67. The vacuum heads 4 may be of any suitable size, shape, construction and location; may be made from any suitable strong, durable material such as metal, plastic or composites; and all of the vacuum heads 4 may not be the same in their respective sizes, shapes, constructions and locations.

The lower sides 69 of the vacuum head 4*s* may taper in width to a relatively narrow support surface 70 that may have chamfered shoulders, in order to help prevent the edges of the support surface 70 from snagging on soft surfaces, such as carpeting, or from scratching hard surfaces. During use of the rotary cleaning head 1, the support surfaces 70 may be in contact with the surface being cleaned, and may at least partially support the rotary cleaning head 1. Alternatively, there may be less, or no, taper in the lower sides 69 of the vacuum heads 4, so that the support surfaces 70 may have a maximum width that is the same as that of the lower sides 69 of the vacuum heads 4.

Figure 9:
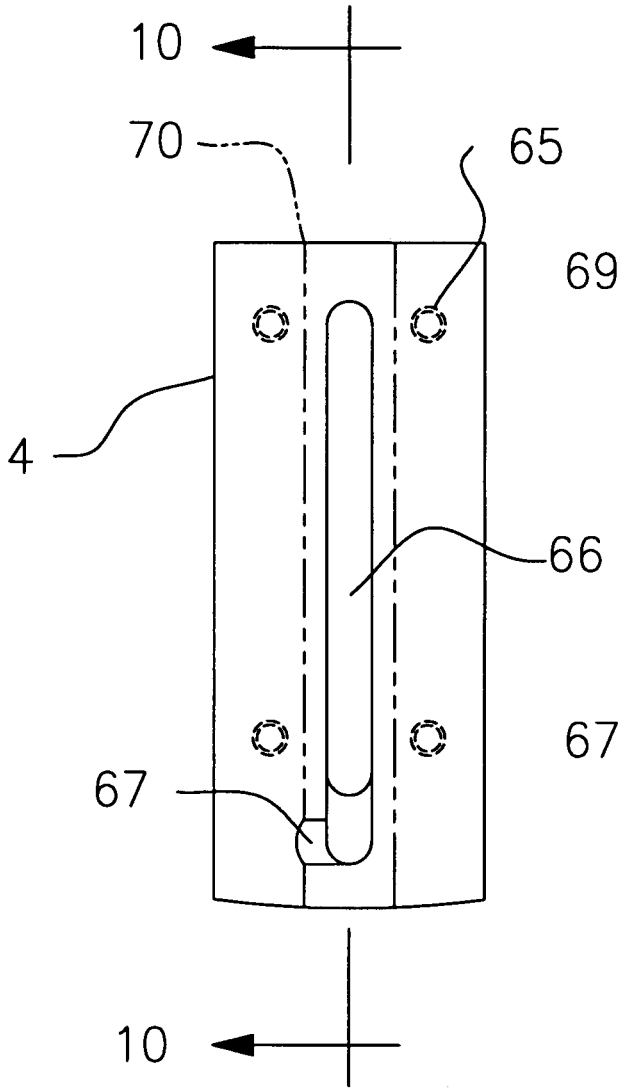
FIG. 9 is a bottom plan view of the vacuum head.
Figure 10:
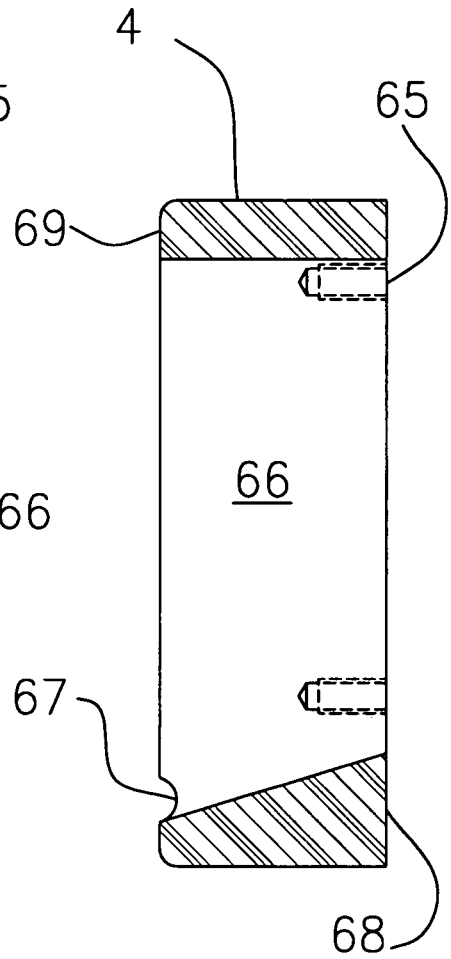
FIG. 10 is a cross-sectional view of the vacuum head, taken along line 10-10 of FIG. 9.
Figure 11:
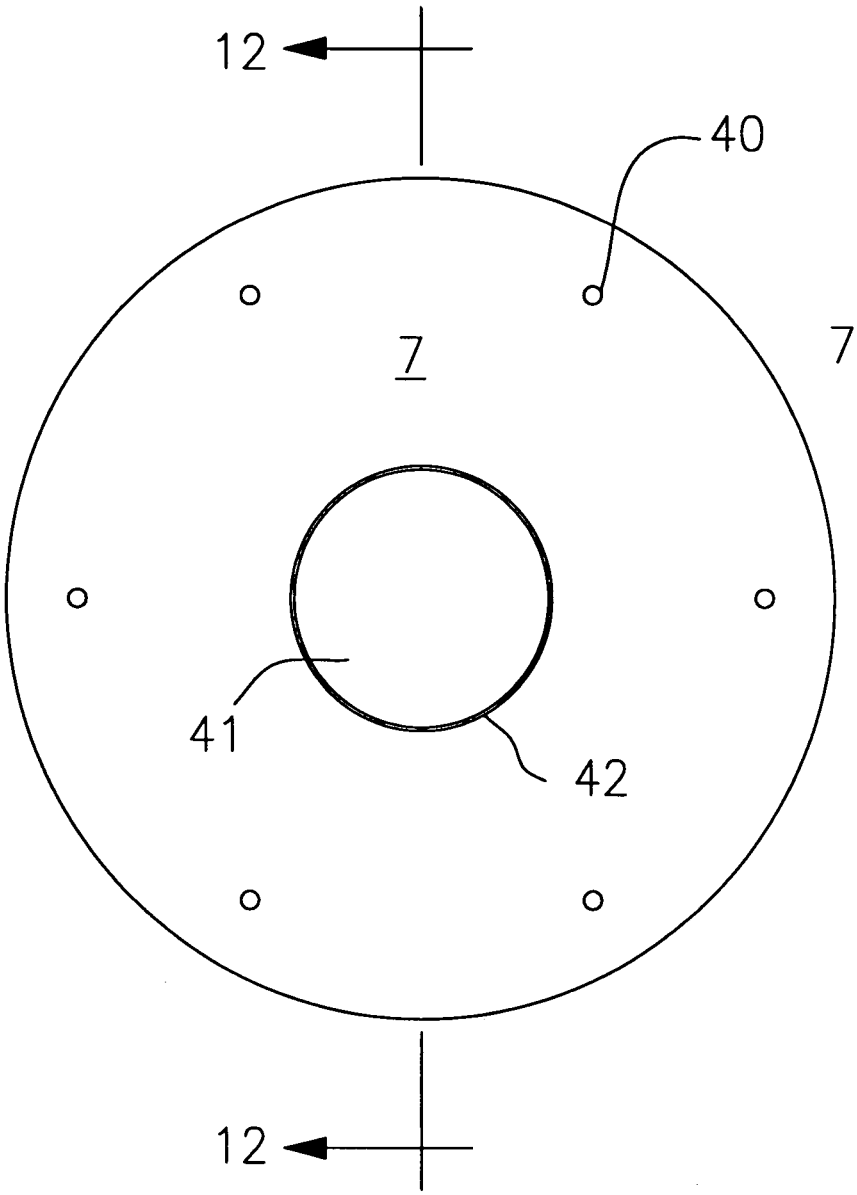
FIG. 11 is top plan view of a cover that may be used in the rotary cleaning head.

One function of the vacuum slots 66 in the vacuum heads 4 may be to convey air, etc., from the surface being cleaned to the corresponding vacuum slots 59 in the main disc 2. The vacuum slots 66 may increase in length from the upper sides 68 of the vacuum heads 4 to their lower sides 69, as best seen in FIGS. 9-10. This increase in length permits the vacuum slots 66 to reach closer to the periphery of the main disc 2 than would otherwise be the case, for better vacuuming action. Alternatively, the length of the vacuum slots 66 may be uniform between the vacuum head 4's upper and lower sides 68, 69. The vacuum slots 66 may be of any suitable size, shape, construction and location; and all of the vacuum slots 66 may not be the same in size, shape, construction and location. As an alternative, there may be more than one vacuum slot 66 in any particular vacuum head 4.

The vacuum notches 67 of the vacuum heads 4 may be one of the important features of the present invention, since they may serve the function of routing into the vacuum slots 66 at least some of the cleaning fluid being slung outwardly by centrifugal force along the outer surfaces 83, 69 of the vacuum heads 4. Thus, the vacuum notches 67 may help to prevent the undesirable spraying of the cleaning fluid out from the rotary cleaning head 2, where it might damage walls or furnishings, for example. The vacuum notches 67 may be oriented so that they extend in a direction towards the adjacent spray nozzle 12, and facing the direction in which the rotary cleaning head 1 is turning. This is because the side 83 of each vacuum head 4 that is closest to the adjacent spray nozzle 12, and that is closest to the direction in which the rotary cleaning head 1 is turning, will tend to be the wettest.

The vacuum notches 67 may be of any suitable size, shape, construction and location. For example, rather than the vacuum notches 67 being located only in the support surfaces 70 of the vacuum head 4, as an alternative they may extend part, or all, of the way across the lower side 69 of the vacuum head 4, and they may extend part, or all, of the way down the sides 83 of the vacuum heads 4. The functions of such elongated vacuum notches 67 may include helping to collect and direct water, etc. into the portion of the vacuum notch 67 that lies in the support surface 70. As further alternatives, there may be more than one vacuum notch 67 in any particular vacuum head 4, or the vacuum notch 67 in any particular vacuum head 4 may be eliminated. All of the vacuum notches 67 may not be the same in their respective sizes, shapes, constructions and locations.

As another alternative, any particular vacuum head 4 may include a ridge 85 that may extend part, or all, of the way across the lower side 69 of the vacuum head 4, and that may extend part, or all, of the way down the side 83 of the vacuum head 4. The radially inward surfaces of the ridge 85 may be flat and vertical with respect to the respective surfaces 69, 83 of the vacuum head 4, or may be flat and inclined at an acute angle with respect to the respective surfaces 68, 83, to aid in the ability of the ridge 85 to serve its functions. The functions of the ridge 85 may include helping to collect and direct water, etc. into the vacuum notch 67 on that vacuum head 4. All of the ridges 85 may not be the same in their respective sizes, shapes, constructions and locations. Both a ridge 85 and an elongated vacuum notch 67 may be used on any particular vacuum head 4.

Although three vacuum heads 4 are illustrated, as an alternative there may be one, two, or more than three vacuum heads 4. Regardless of the number of vacuum heads 4, the rotary cleaning head 1 may have for each vacuum head 4 a respective vacuum slot 59, vacuum channels 44, 57; and vacuum distribution hubs 45, 58. Similarly, each vacuum head 4 may have an associated spray arm 10, elbow 11 and nozzle 12 located near to it.

In order to assemble the rotary cleaning head 1, the spindle O-ring 16 and the sprayer O-ring 17 may be placed in their respective recesses 55, 60 in the main disc 2. The assembly screws 15 may then be used to assemble the spindle 6 and the spindle O-ring 16 to the upper surface of the main disc 2's central boss 54, and to assemble the sprayer 3 and the sprayer O-ring 17 to the bottom of the main disc 2, by placing the assembly screws 15 sequentially through the holes 38 in the spindle flange 37 and the holes 52 in the central boss 54; and by then threading them into the threaded holes 61 in the hub 9 of the sprayer 3.

The assembly screws 20 may be used to assemble the cover 7, the seal 14 and the hollow spacers 39 to the upper surface of the main disc 2 by placing the assembly screws 20 sequentially through the holes 40 in the cover 7 and the holes in the hollow spacers 39; and by then threading them into the threaded holes 46 in the main disc 2.

The mounting screws 19 may be used to mount the glide shoes 5 to the lower surface of the main disc 2 by passing them through the mounting bores 63 in the glide shoes 5, and by then screwing them into the threaded mounting holes 47 in the lower side of the main disc 2.

The mounting screws 18 may be used to mount the vacuum heads 4 to the lower surface of the main disc 2 by passing them through the mounting holes 48 in the main disc 2, and by then screwing them into the threaded mounting bores 65 in the vacuum heads 4.

Referring now to FIGS. 1 and 4, the rotary cleaning head 1 may then be mounted to the cleaning machine 13 by screwing the drive threads 36 on the spindle 6 into corresponding drive threads 71 on the interior of a hollow drive sleeve 72. During use of the rotary cleaning head 1, when the drive motor 30 is actuated it drives a gear box 76 having a drive gear (not illustrated, for clarity) that drives the drive sleeve 72 which, in turn, drives the spindle 6, thereby causing the rotary cleaning head 1 to rotate.

As best seen in FIGS. 1 and 4, cleaning fluid may be supplied to the rotary cleaning head 1 through the rotary coupling 28 in any suitable way, such as by screwing the output fitting 73 of the rotary coupling 28 into a hollow threaded pipe fitting 74, which is, in turn, screwed into the top of the hollow drive sleeve 72.

During use of the rotary cleaning head 1, the cleaning fluid travels from the rotary coupling 28 sequentially through its output fitting 73, the hollow pipe fitting 74, the cleaning fluid bore 35 in spindle 6, the cleaning fluid bore 56 in the central boss 54 of the main disc 2, the hollow hub 9 of sprayer 3, the spray arms 10 and the hollow elbows 11 to the spray nozzles 12.

As best seen in FIG. 4, vacuum may be supplied to the rotary cleaning head 1 by attaching a source of vacuum to the vacuum coupling 33. During use of the rotary cleaning head 1 air, used cleaning fluid, dirt and debris travel through the rotary cleaning head 1 following the path generally indicated by the flow line 75; i.e. they travel sequentially through the vacuum slots 66 and notches 67 in the vacuum heads 4; the vacuum slots 59 in the main disc 2; the vacuum channels 44 and 57 in the seal 14 and the upper side of the main disc 2; the vacuum distribution hubs 45, 58 in the seal 14 and the upper side of the main disc 2; the vacuum opening 41 in the cover 7; the inlet 81 of the vacuum plenum 32; the vacuum plenum 32; and the vacuum coupling 33.

It is understood that any particular part of the rotary cleaning head 1 may be suitably combined or formed with one or more of its other parts to form a composite part, without departing from the scope and spirit of the present invention. For example, the spacers 39 may be formed as part of the main disc 2; or the spindle 6 may be formed as part of the main disc 2.

Similarly, it is understood that any particular part of the rotary cleaning head 1 presently shown as being made in one piece may be formed by assembling together in any suitable way, two or more sub-pieces, without departing from the scope and spirit of the present invention. For example the rim 53 and central boss 54 of the main disc 2 might be made as separate sub-pieces, which may then be assembled to the rest of the main disc 2 in any suitable way, to form the completed main disc 2.

It is to be further understood that any different number of the screws, e.g. screws 15, 18, 19, and 20 (and their associated holes or bores, e.g., 38, 40, 46, 47, 48, 52, 61, 63, and 65) may be used in lieu of the number of those screws and their associated holes or bores that have been described and illustrated herein, without departing from the scope and spirit of the present invention. In addition, the direction of travel of one or more of those screws may be reversed without departing from the scope and spirit of the present invention. For example, the direction of travel of the mounting screws 19 for the glide feet 5 may be reversed, so that the mounting screws 19 first pass through the holes 47 in the main disc 2 and are then screwed into the mounting bores 63 of the glide feet 5.

It is to be additionally understood that the manner in which the various parts of the rotary cleaning head 1 may be assembled together that has been described herein is strictly by way of non-limiting example, since the various parts of the rotary cleaning head 1 may be assembled together in any other suitable way, by using any other suitable means, such as by using rivets, nuts and bolts, welding, gluing, screwing together, friction fits, keys, etc., in lieu of one or more of the screws 15, 18, 19, and 20 described herein, without departing from the scope and spirit of the present invention.

The rotary cleaning head 1 may be particularly adapted to be used to clean carpeted surfaces. However, in general, the rotary cleaning head 1 may be easily modified for use to clean any hard or soft surface, by suitably selecting any suitable and needed sprayers 3, vacuum heads 4, and glide shoes 5.

Figure 15:
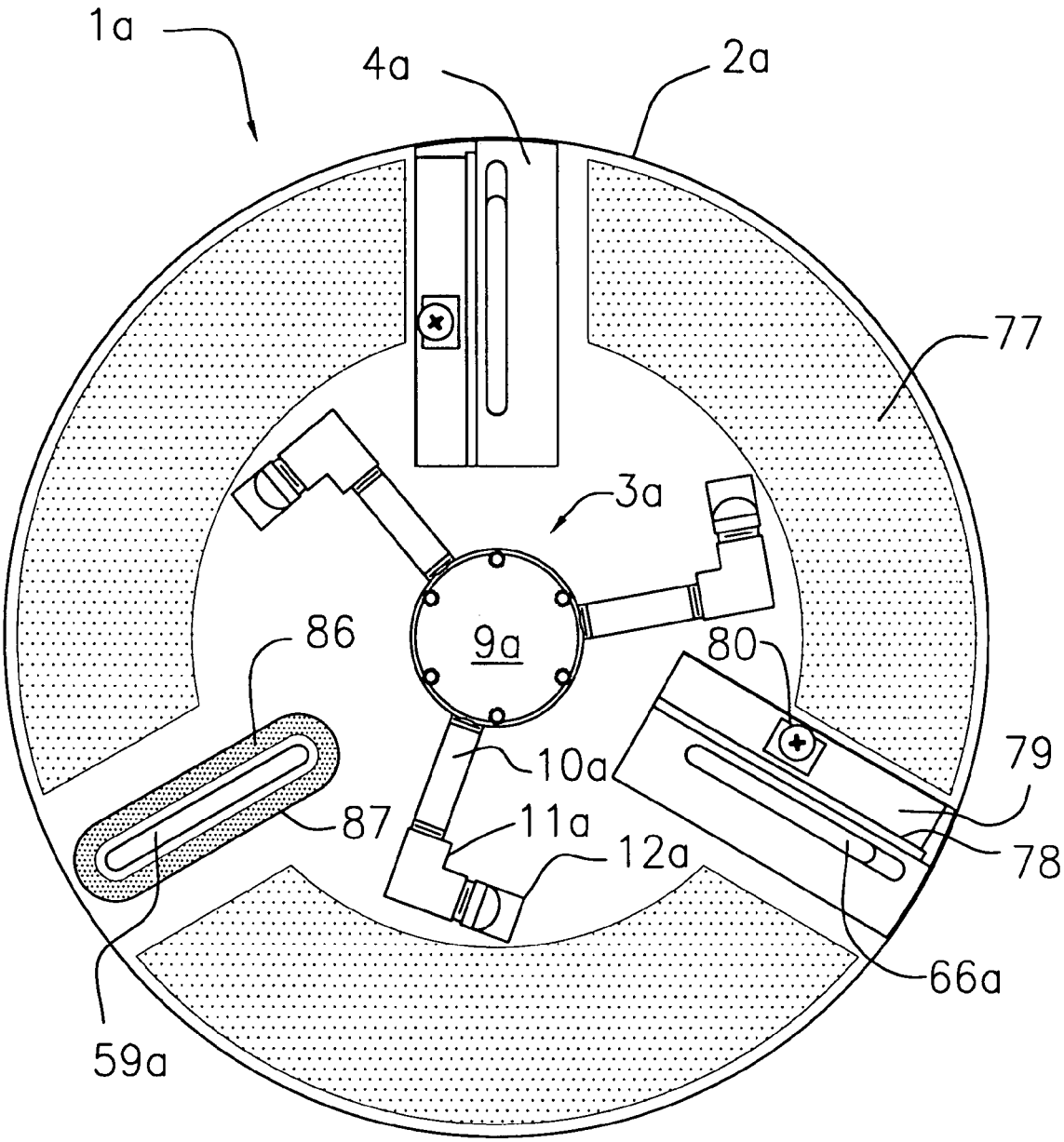
FIG. 15 is a bottom plan view of another embodiment of the present invention.

For example, the rotary cleaning head 1*a* of FIG. 15 may be particularly adapted to be used to clean any hard surfaces, such as those made of wood, tile, vinyl, composition, or concrete. The rotary cleaning head 1*a* may be the same as, or at least similar to, the rotary cleaning head 1 in any particular respect, such as with respect to their respective mountings, locations, quantities (how many), sizes, shapes, designs, materials, compositions, constructions, manufactures, physical properties, dimensions, specifications, variations, operations, methods, and uses, except for those differences which will be made apparent by all of the disclosures herein. Accordingly, for clarity, certain parts of the rotary cleaning head 1*a* have been given the same reference numerals as the corresponding parts of rotary cleaning head 1, but with an "a" suffix.

The rotary cleaning head 1*a* may incorporate any suitable patterns of conventional hard surface scrubbing bristles 77 carried by the main disc 2*a*'s lower side in any suitable way, to aid in cleaning a hard floor, and may have three vacuum heads 4*a*, each of which may carry a squeegee 78 held in place by a clamping block 79 and mounting screw 80. Alternatively the squeegee 78 could be held in place in the vacuum head 4*a* in any other suitable way, such as by being secured in a squeegee slot in the vacuum head 4*a* with any suitable adhesive, or by being formed with a head that may be slid into a correspondingly shaped slot in the vacuum head 4*a*. The spray arms 10*a* may be shorter than the spray arms 10 of the rotary cleaning head 1, in order to fit within the inner circumference of the pattern of bristles 77. Only two of the three vacuum heads 4*a* are illustrated in FIG. 15; the third vacuum head 4*a* having been replaced for illustrative purposes in FIG. 15 by an alternative construction which will now be described.

As an alternative to having vacuum heads 4*a* mounted to the lower side of the main disc 2*a* in registry with the corresponding vacuum slots 59*a* in the main disc 2*a*; one or more of the vacuum heads 4*a* may be eliminated, and replaced by a pattern of scrubbing bristles 86 that may be carried by the lower side of the main disc 2*a* in any suitable way. The pattern of bristles 86 may have any suitable size, shape and location on the lower side of the main disc 2*a*, as long as it wholly or partially surrounds its respective vacuum slot 59*a* in the main disc 2*a*. The pattern of bristles 86 may be used in lieu of, or in addition to, one or more of the patterns of bristles 77.

The bristles 86 may be of any suitable length, diameter, stiffness and material, and may have a density of from about 1,000 to 3,500 bristles per square inch, with a preferred density of about 2,250 bristles per square inch.

A guard 87 which may be made of any suitable elastic or resilient material, such as an elastomer, may wholly or partially surround the pattern of bristles 86. The guard 87 may be carried by the main disc 2*a* in any suitable way; or it may be carried by the bristles 86 in any suitable way, such as by being secured to them with any suitable adhesive. The guard 87 may have any suitable thickness, and may have a height that is the same as, or less than, the length of the bristles 86. One function of the guard 87 may be to help prevent the passage of air, used cleaning fluid, dirt and debris through one or more of the sides of the pattern of bristles 86, so that the vacuum effect from the vacuum slot 59*a* may be concentrated on the portion of surface being cleaned that is located under the vacuum slot 59*a*. Another function of the guard 87 may be to help to prevent the bristles 86 from being bent or distorted during use, in order to increase their useful working life.

By way of further example, U.S. Pat. No. 5,517,715 issued on May 21, 1996 for a Cleaning Head, the contents of which are incorporated herein by reference, discloses rotary cleaning heads 8 that may be particularly adapted to clean carpeted surfaces. The cleaning heads 8 may comprise vacuum scrubber feet 30, and spray nozzles 40 that are directly connected to a central hub 16. The vacuum scrubber feet 30 may modified as needed and substituted for the vacuum heads 4 of the present invention; and the spray nozzles 40 may be modified as needed and connected to the hub 9 of the sprayer 3 of the present invention in lieu of the spray arms 10, elbows 11 and nozzles 12 of the present invention.

Thus it is seen that by suitably selecting the size, shape, number, location or type of vacuum shoes 4, 4*a*, patterns of bristles 77 and 86, and sprayers 3, 3*a* (and their various components); the rotary cleaning heads 1, 1*a* may be quickly and easily customized to be used on any type of hard or soft surfaces. The rotary cleaning heads 1, 1*a* may be further customized in any other suitable way for cleaning any type of surface by incorporating or substituting any other kind of suitable cleaning elements, such as cleaning pads, for example, into the rotary cleaning heads 1, 1*a*.

As used herein, except in the claims, the words "and" and "or" are each defined to also carry the meaning of "and/or".

If the term "at least one of" is used in any of the claims, that term is defined to mean that any one, any more than one, or all, of the listed things following that term is, or are, part of the claimed invention. For example, if a hypothetical claim recited "at least one of A, B, and C", then the claim is to be interpreted so that it may comprise (in addition to anything else recited in the claim), an A alone, a B alone, a C alone, both A and B, both A and C, both B and C, or all of A, B and C.

It is understood that the foregoing forms of the invention were described and illustrated strictly by way of non-limiting example.

In view of all of the disclosures herein, these and further modifications, adaptations and variations of the present invention will now be apparent to those of ordinary skill in the art to which it pertains, within the scope of the claims.

What is claimed is:

1. A rotary cleaning head for a cleaning machine for a floor, wherein said rotary cleaning head is operable to receive a vacuum from a source of vacuum, to receive a cleaning fluid from a source of cleaning fluid, and to receive rotation from a source of rotary power; wherein said rotary cleaning head has an axis of rotation; and wherein said rotary cleaning head comprises:

a drive spindle, a vacuum distribution hub; a vacuum channel; a main disc having an upper surface and a lower surface; a main disc cover having an upper surface and a lower surface; and a main disc seal operable to provide a seal between said main disc and said main disc cover; wherein said main disc, said main disc cover and said main disc seal rotate about said axis of rotation during operation of said rotary cleaning head;

wherein said drive spindle comprises a bore; and wherein said bore is operable to receive said cleaning fluid from said source of cleaning fluid;

wherein said drive spindle is operable to receive said rotation from said source of rotary power; wherein said drive spindle is not operable to receive said vacuum from said source of vacuum; and wherein said drive spindle is not operable to convey said vacuum from said source of vacuum to said vacuum distribution hub;

wherein said vacuum distribution hub and said vacuum channel are in fluid communication with each other and are located between at least a portion of said upper surface of said main disc and said lower surface of said main disc cover; wherein said vacuum distribution hub rotates about said axis of rotation during operation of said rotary cleaning head; and wherein said vacuum channel extends outwardly, away from said axis of rotation, and rotates about said axis of rotation during operation of said rotary cleaning head;

wherein said main disc further comprises a main disc vacuum port; wherein said main disc vacuum port extends through said lower surface of said main disc and is in fluid communication with said vacuum channel; and wherein said main disc vacuum port rotates about said axis of rotation during operation of said rotary cleaning head;

wherein said main disc cover comprises a vacuum opening; wherein said vacuum opening extends through said upper surface of said main disc cover; wherein said vacuum opening is in fluid communication with said vacuum distribution hub and is operable to be connected to said source of vacuum; wherein said vacuum opening rotates about said axis of rotation during operation of said rotary cleaning head; and wherein, despite said rotation of said rotary cleaning head, said rotary cleaning head is operable to provide a continuity of vacuum from said source of vacuum to said main disc vacuum port via said vacuum opening in said main disc cover, said vacuum distribution hub, and said vacuum channel.

2. The rotary cleaning head according to claim 1, wherein said main disc seal is sandwiched between at least a portion of said upper surface of said main disc and said lower surface of said main disc cover; wherein said main disc seal is operable to not only provide said seal between said main disc and said main disc cover, but is also operable to at least partially define at least one of said vacuum distribution hub and said vacuum channel.

3. The rotary cleaning head of claim 1, wherein said rotary cleaning head further comprises a cover seal located between said main disc cover and said source of vacuum; wherein there is rotation of said main disc cover with respect to said source of vacuum during operation of said rotary cleaning head; and wherein, despite said rotation of said main disc cover, said cover seal is operable to at least partially prevent a vacuum leak between said source of vacuum and said upper surface of said main disc cover.

4. The rotary cleaning head of claim 1, wherein said rotary cleaning head further comprises a vacuum head secured to said lower surface of said main disc; wherein said vacuum head defines a vacuum head vacuum slot; and wherein said vacuum head vacuum slot is in fluid communication with said main disc vacuum port.

5. The rotary cleaning head of claim 4, wherein said vacuum head further comprises a vacuum head vacuum notch; wherein said vacuum head vacuum notch is in fluid communication with said vacuum head vacuum slot; and wherein said vacuum head vacuum notch is sized and located to be operable to route into said vacuum head vacuum slot at least some of said cleaning fluid after said cleaning fluid has been used by said rotary cleaning head, to prevent at least some undesirable outward flinging of said cleaning fluid from said rotary cleaning head after said cleaning fluid has been used by said rotary cleaning head.

6. The rotary cleaning head of claim 4, wherein said vacuum head further comprises an outer surface; and a vacuum head ridge that extends outwardly from said outer surface of said vacuum head; and wherein said vacuum head ridge is sized and located to be operable to route into said vacuum head vacuum slot at least some of said cleaning fluid after said cleaning fluid has been used by said rotary cleaning head, to prevent at least some undesirable outward flinging of said cleaning fluid from said rotary cleaning head after said cleaning fluid has been used by said rotary cleaning head.

7. The rotary cleaning head of claim 4, wherein said vacuum head further comprises a vacuum head squeegee; and wherein said vacuum head squeegee is sized and located to be operable to route into said vacuum head vacuum slot at least some of said cleaning fluid after said cleaning fluid has been used by said rotary cleaning head, to prevent at least some undesirable outward flinging of said cleaning fluid from said rotary cleaning head after said cleaning fluid has been used by said rotary cleaning head.

8. The rotary cleaning head of claim 1, wherein said main disc further comprises an area of scrubbing bristles located on said lower surface of said main disc; wherein said floor comprises a hard surface; and wherein said area of scrubbing bristles is operable to assist in cleaning said hard surface.

9. The rotary cleaning head of claim 1, wherein said main disc vacuum port comprises a main disc vacuum slot; wherein said main disc further comprises a pattern of scrubbing bristles located on said lower surface of said main disc; wherein said pattern of scrubbing bristles at least partially surrounds said main disc vacuum slot; wherein said floor comprises a hard surface; and wherein said pattern of scrubbing bristles is operable to assist in cleaning said hard surface.

10. The rotary cleaning head of claim 9, wherein said main disc further comprises a guard located on said lower surface of said main disc; wherein said guard at least partially surrounds said pattern of scrubbing bristles; wherein said pattern of scrubbing bristles has a side; and wherein said guard is at least partially operable to prevent a passage of said cleaning fluid through said side of said pattern of scrubbing bristles, to concentrate a vacuum effect from said main disc vacuum port on a portion of said hard surface that is located under said main disc vacuum port.

11. The rotary cleaning head of claim 1, wherein said rotary cleaning head further comprises a spray arm; wherein said spray arm is located beneath said lower surface of said main disc; and wherein said spray arm is operable to receive said cleaning fluid from said source of cleaning fluid, to convey said cleaning fluid radially outwardly away from said axis of rotation, and to spray said cleaning fluid onto said floor.

12. The rotary cleaning head of claim 1, wherein said drive spindle is mounted to at least one of said main disc and said main disc cover.

13. The rotary cleaning head of claim 12, wherein said rotary cleaning head further comprises a spray arm; wherein said spray arm is located beneath said lower surface of said main disc; and wherein said bore of said drive spindle is operable to provide said cleaning fluid to said spray arm.

14. The rotary cleaning head of claim 1, wherein said rotary cleaning head further comprises a glide; wherein said glide is secured to said lower surface of said main disc; wherein said glide is not operable to receive said vacuum from said source of vacuum; and wherein said glide is operable to at least partially support said main disc on said floor.

* * * * *